US006709370B1

(12) United States Patent
Evans

(10) Patent No.: US 6,709,370 B1
(45) Date of Patent: Mar. 23, 2004

(54) WEIGHTBENCH DUMBBELL SUPPORT APPARATUS

(76) Inventor: Steven Lee Evans, 300 W. Magnolia St., Siloam Springs, AR (US) 72761

( * ) Notice: Subject to any disclaimer, the term of this patent is extended or adjusted under 35 U.S.C. 154(b) by 0 days.

(21) Appl. No.: 10/397,745

(22) Filed: Mar. 25, 2003

Related U.S. Application Data

(63) Continuation-in-part of application No. 29/161,714, filed on May 30, 2002.

(51) Int. Cl.[7] ..... A63B 21/78

(52) U.S. Cl. ..... 482/104; 482/142; 482/94

(58) Field of Search ..... D21/679, 690, D21/681, 686, 694, 662; 482/100–109

(56) References Cited

U.S. PATENT DOCUMENTS

| | | | | | |
|---|---|---|---|---|---|
| 5,725,460 | A | * | 3/1998 | Marsh | 482/104 |
| 5,924,964 | A | * | 7/1999 | Hayden | 482/104 |
| 5,954,619 | A | * | 9/1999 | Petrone | 482/104 |
| D441,813 | S | * | 5/2001 | Ceppo | D21/686 |
| D453,542 | S | * | 2/2002 | Louiso | D21/694 |

* cited by examiner

*Primary Examiner*—Jerome W. Donnelly
(74) *Attorney, Agent, or Firm*—Keisling Pieper & Scott PLC; Trent G. Keisling; David B. Pieper

(57) ABSTRACT

A vertically and angularly adjustable dumbbell holder is provided which allows for positioning of the dumbbell for various exercises. Multiple dumbbells may be supported from a single elongated weight bench and angularly and vertically positioned for a variety of exercises. The dumbbells are held in position by side supports when the dumbbell handles are used as a base support for exercises.

18 Claims, 3 Drawing Sheets

WEIGHTBENCH DUMBBELL SUPPORT APPARATUS

CROSS-REFERENCE TO RELATED APPLICATIONS

This application claims priority to and is a continuation-in-part of U.S. design application Ser. No. 29/161,714, filed on May 30, 2002.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of dumbbell supports in general. In particular, the present invention relates specifically to a weight bench and dumbbell support apparatus.

2. Description of the Known Art

As will be appreciated by those skilled in the art, a dumbbell support may be used to support a dumbbell off of a weight bench. Details of a typical dumbbell support are contained in U.S. Pat. No. 5,924,964, issued to Hayden on Jul. 20, 1999; U.S. Pat. No. 4,998,723 issued to Santoro on Mar. 12, 1991; U.S. Pat. No. 4,973,050 issued to Santoro et al. on Nov. 27, 1990; U.S. Pat. No. 4,598,908 issued to Morgan on Jul. 8, 1986; U.S. Pat. No. 5,928,118 issued to Rosenthal on Jul. 27, 1999; U.S. Pat. No. 4,546,967 issued to Kecala on Oct. 15, 1985; and U.S. Pat. No. 5,725,460 issued to Marsh on Mar. 10, 1998. Each of these patents is hereby expressly incorporated by reference in their entirety.

These prior art patents are very limited in their teaching and utilization, and an improved dumbbell support is needed to overcome these limitations. What is needed then is an improved weight bench dumbbell support for providing variable positioning and support for dumbbells and improved weigh bench performance.

SUMMARY OF THE INVENTION

The present invention is directed to an improved weight bench with dumbbell support. In accordance with one exemplary embodiment of the present invention, a dumbbell holder is provided for an elongated weight bench that includes side attachment tubes.

The dumbbell holder includes a vertical supporting arm adapted to attach to the side attachment tube of a weight bench. A dumbbell cross support is attached to the vertical supporting arm. The cross support has a first connecting point and distal connecting point. An initial weight support cup is attached to the first connecting point. The initial weight support cup has a first weight vertical support and a first side support, and is constructed so that the first side support defines a first side movement limit for the dumbbell. This side support secures the dumbbell so that the dumbbell will not fall or slide out of the dumbbell holder. Additional side supports may be utilized, and separate weight support cups may be used for each side of the dumbbell. When using multiple weight support cups, a handle aperture may be formed by spacing of the two weight support cups.

Another improvement teaches that the vertical support may be made as a radially symmetrical support so that the dumbbell may be fixed in positioned at various angles to the weight bench. A perpendicular support allows the use of the dumbbell as a standard cross bar type of arrangement common seen for doing bench presses with barbells. A parallel arrangement may also be used from the bench for exercises such as butterflies done from a horizontal position.

Yet a further improvement may be had using a second vertical support attached to the opposite side of the weight bench. The use of a separate independent support creates a usable gap above the bench so that a parallel arrangement of two dumbbells in the holders allows for elbow bends above the bench. The separate independent support and a perpendicular arrangement allows for additional exercises or ranges of motion such as a below bar extension on elevated push ups.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
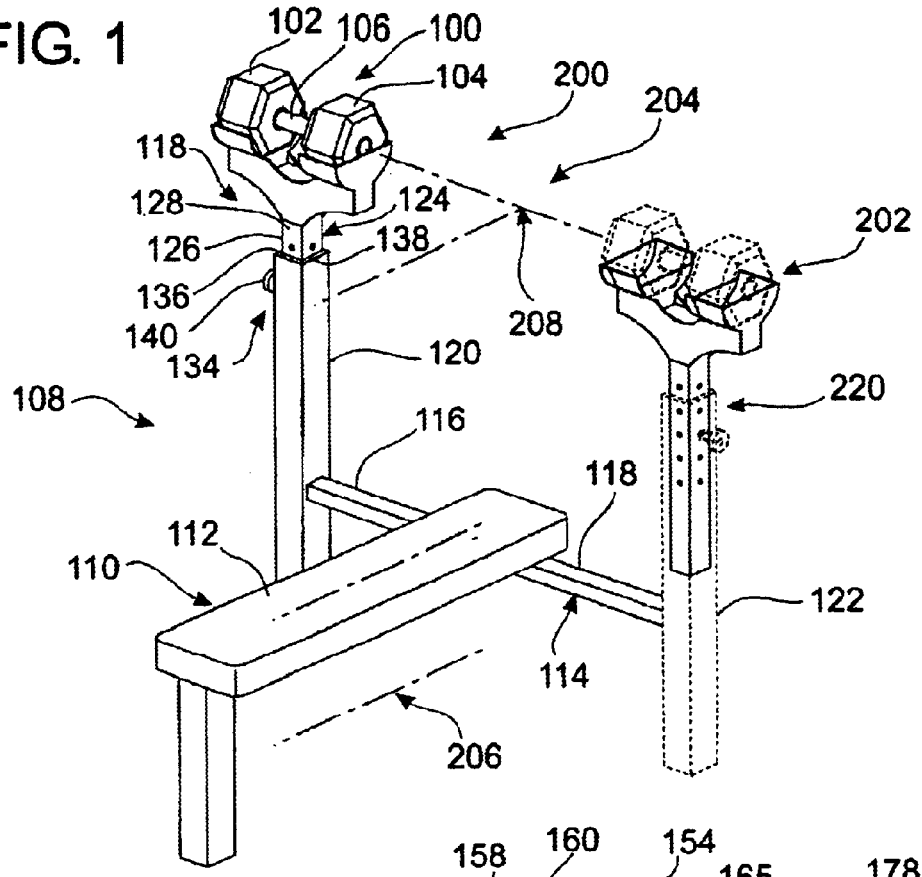
FIG. 1 is an environmental view of a weight bench with dumbbell support with a portion of the weight bench shown in dashed lines for clarification of the construction of the apparatus.
Figure 2:
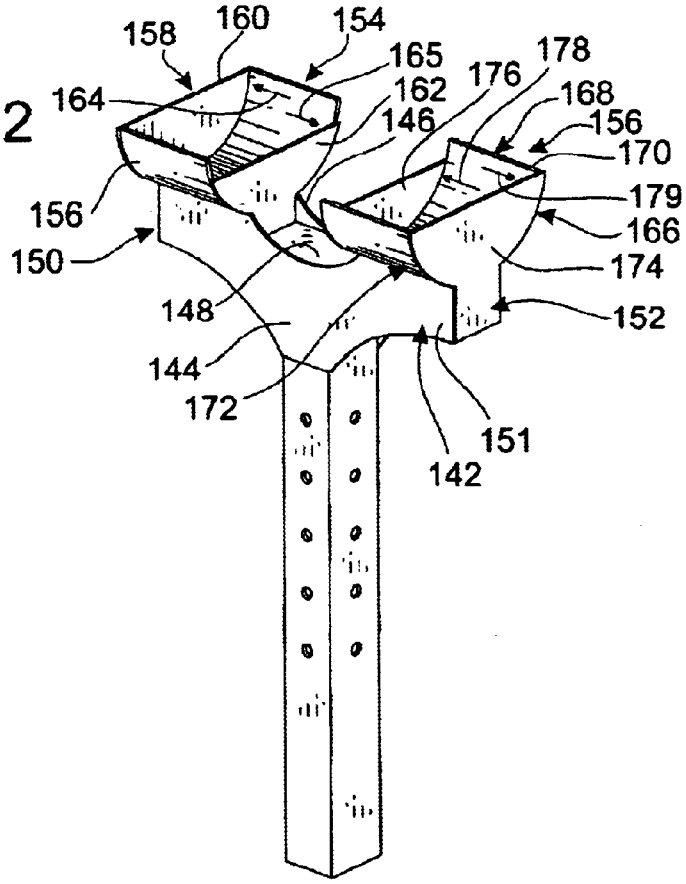
FIG. 2 is a perspective view thereof.
Figure 3:
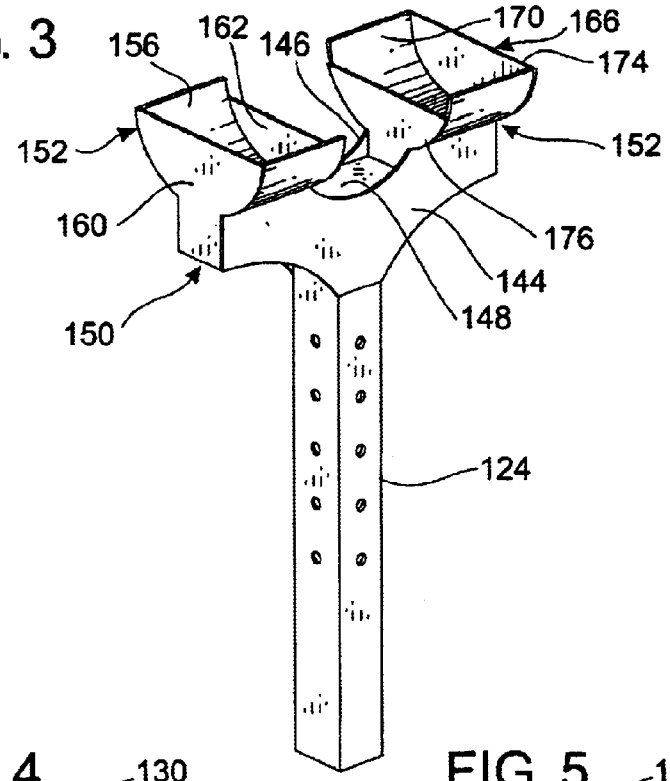
FIG. 3 is a perspective view thereof, taken generally from the opposite side of FIG. 2.
Figure 4:
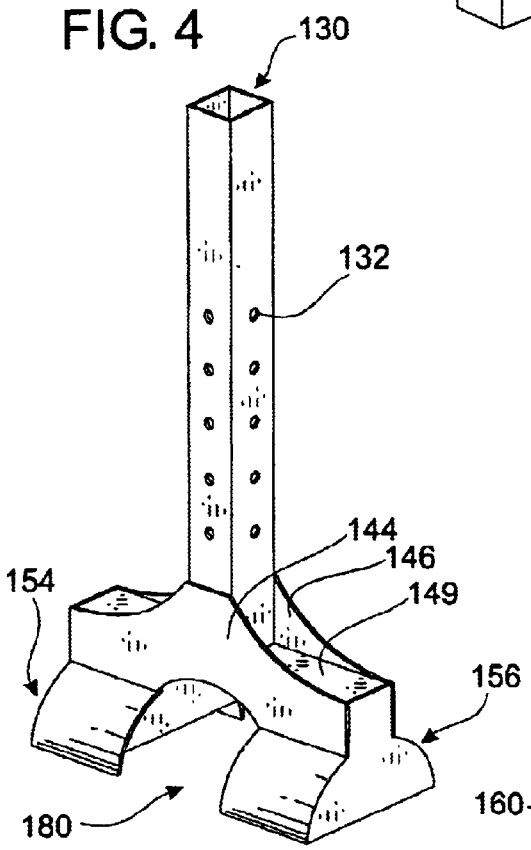
FIG. 4 is a perspective view thereof, taken generally oppositely to FIG. 2.
Figure 5:
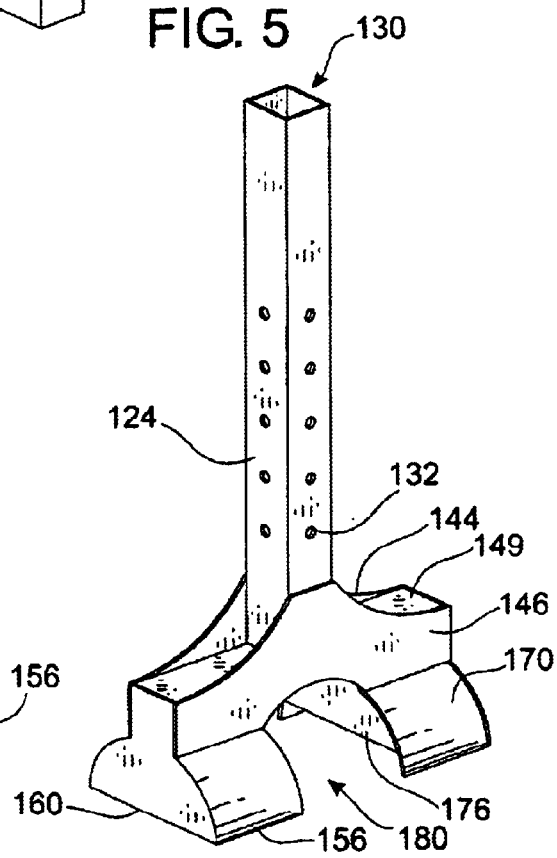
FIG. 5 is a perspective view thereof, taken generally from the opposite side of FIG. 4.
Figure 6:
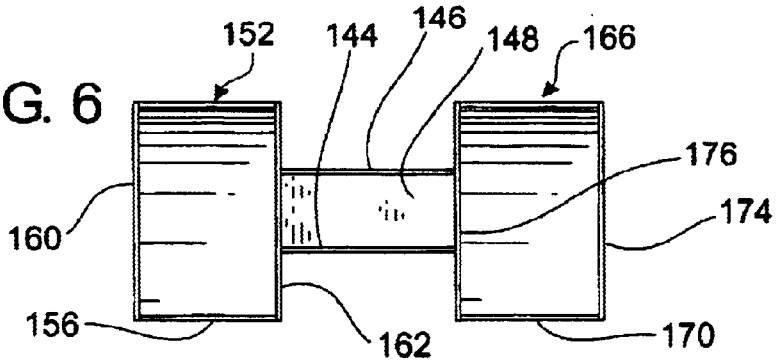
FIG. 6 is a top plan view thereof.
Figure 7:
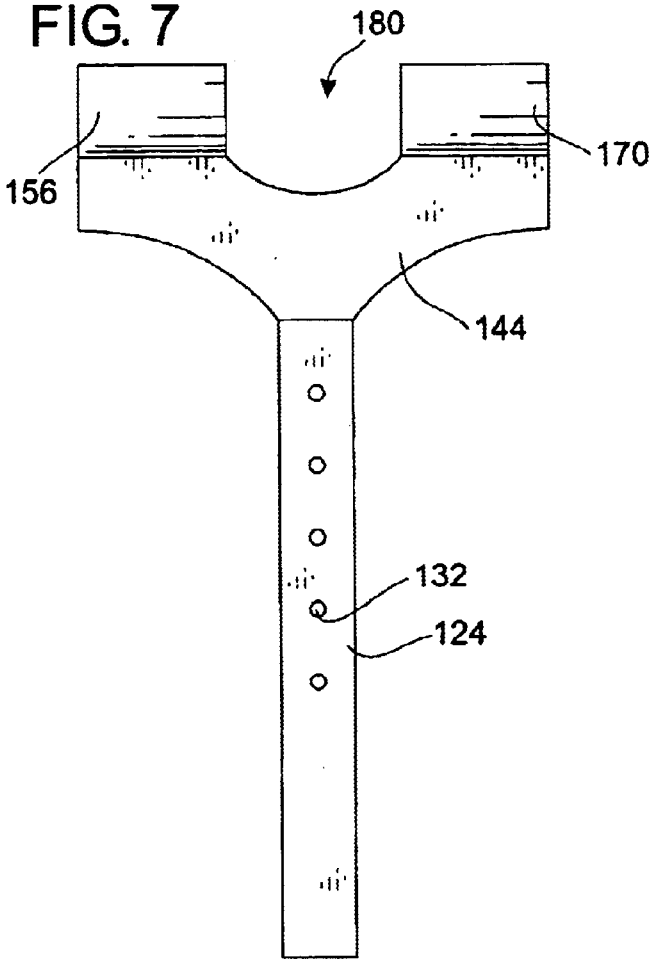
FIG. 7 is a front elevational view with the opposite side being a mirror image thereof.
Figure 8:
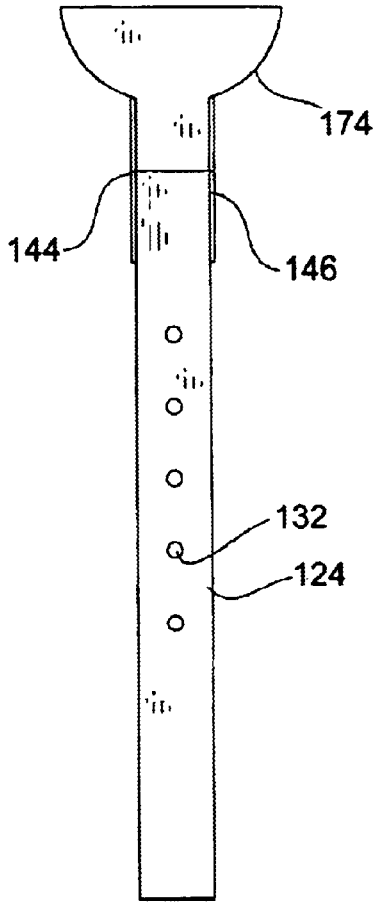
FIG. 8 is a side elevational view with the opposite side being a mirror image thereof; and, FIG. 9 is a bottom plan view thereof.
Figure 9:
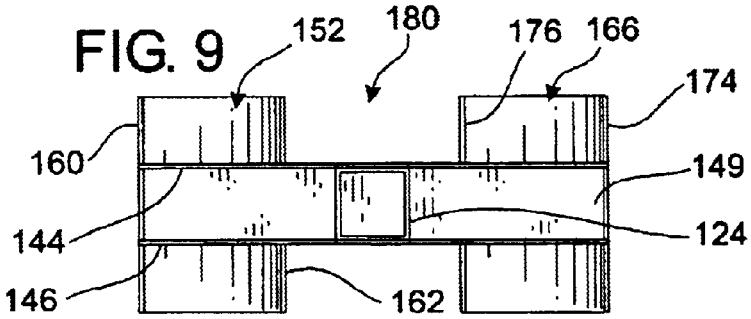

As shown in FIG. 1, a dumbbell 100 is usually constructed utilizing a first end weight 102 and a second end weight 104 connected by a handle 106.

As detailed in FIGS. 1–9, a dumbbell holding apparatus 108 is constructed for attachment to an elongated weight bench 110. The elongated weight bench 110 includes a bench seat 112 supported by a bench support frame 114. The bench support frame 114 of the elongated weight bench 110 has a first side 116 with a first side attachment tube 120 and a second side 118 having a second side attachment tube 122. The dumbbell holding apparatus 108 utilizes a vertical supporting arm 124 constructed with an elongated extension 126 having an extension shape 128 that is shown as a square tube. The extension shape 128 is preferably constructed with radial symmetry 130 such that the elongated extension 126 may be rotated for positioning inside the attachment tubes 120, 122 for adjusting the angular relationship of the dumbbell 100 to the elongated weight bench 110. The vertical supporting arm 124 is also constructed with vertical positioning apertures 132 so that the vertical supporting arm 124 may be held in position with a locking pin 140. The connection of the vertical supporting arm 124 to the side attachment tubes 120, 122 is shown as a vertically and angularly adjustable attachment 134. This vertically and angularly adjustment attachment 134 utilizes an extension mating shape 136 which also has radial symmetry 138 for connection with the vertical supporting arm 124 such that the vertical supporting arm 124 may be rotated to adjust the angular relationship of the dumbbell 100 to the elongated weight bench 110.

The vertical supporting arm 124 is adapted to support a dumbbell cross support 142. The dumbbell cross support 142 is constructed as a first cross arm 144 and a second cross arm 146 connected by a top 148 and a bottom 149. The dumbbell cross support 142 defines a first connecting point 150 and a distal connecting point 151. An initial weight support cup 152 is attached at the first connecting point 150. The initial weight support cup 152 includes a first weight vertical support structure 154 and a first weight side support structure 158. The first weight vertical support structure 154 is constructed as a curved plate 156 to provide vertical and longitudinal support to the dumbbell 100. The first weight side support structure 158 is constructed as a raised outer side wall 160 and a recessed inner side wall 162. The first weight side support structure 158 is adapted to define left and right weight side movement limits 164, 165 so that the dumbbell 100 is supported within the initial weight support cup 152 and is controlled from falling out of the side initial weight support cup 152. This control of the weight position is important for controlling the dumbbell 100 when the dumbbell is used as a handle grip while in initial weight support cup 152.

A second weight support cup 166 is also utilized. The second weight support cup 166 includes a second weight vertical support structure 168 manufactured as a curved plate 170. The second weight support cup 166 also includes a second weight left side support structure 172 which also includes a raised outer side wall 174 and a recessed inner side wall 176. The second weight side support structure 172 is also adapted to provide a second weight left side movement limit 178 and second weight right side movement limit 179 for controlling the movement of the dumbbell 100. The initial weight support cup 152 and the second weight support cup 166 are separated by a distanced defining a handle aperture 180 as is known in the prior art for use with dumbbells 100. This not only allows for gripping of the dumbbell 100 for pickup, but provides a hand positioning location when the dumbbell 100 is used in its seated position.

As is shown in the drawings, a first vertically independent dumbbell holder 200 and a second vertically independent dumbbell holder 202 may be utilized to form an obstruction-free aperture 204. Utilizing the vertically and angularly adjustable attachment 134 previously described, this allows for the arrangement of the dumbbells 100 in a parallel 206 or perpendicular 208 arrangement. Other arrangements may also be utilized by changing the radial symmetry of the elements of the vertically and angularly adjustable attachment 134. Alternative embodiments may be constructed by utilizing only the angle adjustments to form a first angularly adjustable holder connection and a second angularly adjustable holder connection to allow for angular adjustment of the dumbbells in relation to the elongated weight bench. Yet a further embodiment may be constructed utilizing only the vertical adjustments to form a first vertically adjustable holder connection and a second vertically adjustable holder connection such that the dumbbells may be vertically adjusted in relation to the weight bench. However, the preferred embodiment utilizes a first vertically and angularly adjustable holder connection 218 and a second vertically and angularly adjustable holder connection 220 so that both angle and height adjustments may be made to the dumbbells 100 in relation to the elongated weight bench 110.

By allowing the dumbbells 100 to be angularly adjusted in relation to the elongated weight bench 110, different exercises requiring different positions of the dumbbells 100 may be performed. When the dumbbells 100 are placed in a perpendicular relationship to the elongated weight bench 110, the dumbbells 100 are positioned in the standard bench press-type of arrangement. When the dumbbells 100 are adjusted to be perpendicular to the elongated weight bench 10, the dumbbells 100 are positioned for an exercise such as a horizontal butterfly. The vertical adjustment of the dumbbells 100 combined with the spaced relationship of the dumbbells 100 allows for additional exercises to be performed on the weight bench 110. By having the dumbbells 100 perpendicular to the elongated weight bench an in-air pushup may be performed with the user placing his hands on each of the consecutive dumbbells 100. The user may then perform an in-air pushup and may actually extend below the line formed by the handles 106 of the dumbbells 100 to obtain an additional range of motion. Furthermore, when the dumbbells 100 are arranged parallel to the elongated weight bench the dumbbells 100 in the capturing sockets 152, 166 may be utilized to allow for elbow dips and other types of exercises requiring this type of support. While these examples of exercises are by no means meant to limit the application of the present invention, these examples are provided for understanding of the advantages of the present invention over the prior art designs.

Reference numbers refer to the following:

a dumbbell 100
first end weight 102
second end weight 104
a handle 106
A dumbbell holding apparatus 108
an elongated weight bench 110
a bench seat 112
a bench support frame 114
a first side 116
a second side 118
first side attachment tube 120
second side attachment tube 122
a vertical supporting arm 124
an elongated extension 126
an extension shape 128
radial symmetry 130
vertical positioning apertures 132
a vertically and angularly adjustable attachment 134
an extension mating shape 136
radial symmetry 138
locking pin 140
a dumbbell cross support 142
a first cross arm 144
a second cross arm 146
a top 148
a bottom 149
a first connecting point 150
a distal connecting point 151
an initial weight support cup 152 a first weight vertical support structure 154
a curved plate 156
a first weight side support structure 158
a raised outer side wall 160
a recessed inner side wall 162
first weight left side movement limit 164
first weight right side movement limit 165
a second weight support cup 166
a second weight vertical support structure 168
a curved plate 170
a second weight side support structure 172
a raised outer side wall 174
a recessed inner side wall 176
a second weight left side movement limit 178
a second weight left side movement limit 179
a handle aperture 180
a first vertically independent dumbbell holder 200
a second vertically independent dumbbell holder 202
an obstruction free aperture 204
parallel 206
perpendicular 208
a first vertically and angularly adjustable holder connection 218
a second vertically and angularly adjustable holder connection 220

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A dumbbell holding apparatus for an elongated weight bench with at least one side attachment tube, the dumbbell holding apparatus adapted to support a dumbbell having first and second end weights connected by a handle, the apparatus comprising:

a vertical supporting arm adapted to attach to the at least one side attachment tube;

a dumbbell cross support having a first connecting point and distal connecting point;

an initial weight support cup attached to the first connecting point; and the initial weight support cup having a first weight vertical support and a first side support, the first side support connected to both the first weight vertical support and the dumbbell cross support, the first side support further adapted to define a first side movement limit for the dumbbell.

2. The apparatus of claim 1, the initial weight support cup further comprising:

a second side support adapted to define a second side movement limit for the dumbbell.

3. The apparatus of claim 1, further comprising:

a second weight support cup attached to the distal connecting point.

4. The apparatus of claim 3, the first and second weight support cups spaced to define a handle aperture between the first and second weight support cups.

5. The apparatus of claim 3, the second weight support cup comprising:

a second weight vertical support.

6. The apparatus of claim 1, the vertical supporting arm adapted to attach to the at least one side attachment tube so that the handle of the dumbbell is substantially parallel to the elongated weight bench.

7. The apparatus of claim 1, the vertical supporting arm adapted to attach to the at least one side attachment tube so that the handle of the dumbbell is substantially perpendicular to the elongated weight bench.

8. The apparatus of claim 1, the vertical supporting arm supported by an adjustable attachment adapted to attach to the at least one side attachment tube so that the handle of the dumbbell can be angularly adjusted in relation to the elongated weight bench.

9. The apparatus of claim 3, the second weight support cup further comprising:

a second weight side support, the second weight side support adapted to define a second side movement limit for the dumbbell.

10. A dumbbell support apparatus for use with a weight bench with at least one side attachment tube, the weight bench having a first side and a second side, the dumbbell support apparatus comprising:

a first vertically independent dumbbell holder positioned on the first side of the weight bench, the first vertically independent dumbbell holder having a first dumbbell cross support connected to a first weight vertical support and a first side support, the first side support connected to both the first weight vertical support and the first dumbbell cross support, the first side support further adapted to define a first side movement limit;

a second vertically independent dumbbell holder positioned on the second side of the weight bench, the second vertically independent dumbbell holder having a second dumbbell cross support connected to a second weight vertical support and a second side support, the second side support connected to both the second weight vertical support and the second dumbbell cross support, the second side support further adapted to define a second side movement limit, wherein the first and second vertically independent dumbbell holders are spaced to define an obstruction free aperture.

11. The apparatus of claim 10, the first vertically independent dumbbell holder and the second vertically independent dumbbell holder adapted to attach to the weight bench so that the handles of the dumbbells are substantially parallel to the elongated weight bench.

12. The apparatus of claim 10, the first vertically independent dumbbell holder and the second vertically independent dumbbell holder adapted to attach to the weight bench so that the handles of the dumbbells are substantially perpendicular to the elongated weight bench.

13. The apparatus of claim 10, further comprising:

a first angularly adjustable holder connection adapted to.attach the first vertically independent dumbbell holder to the weight bench, the adjustable holder connection adapted to vary the angle of the handle of the dumbbell in relation to the elongated weight bench.

14. The apparatus of claim 10, further comprising:

a second angularly adjustable holder connection adapted to attach the second vertically independent dumbbell holder to the weight bench, the adjustable holder con nection adapted to vary the angle of the handle of the dumbbell in relation to the elongated weight bench.

15. The apparatus of claim 10, further comprising:

a first vertically adjustable holder connection adapted to attach the first vertically independent dumbbell holder to the weight bench, the first vertically adjustable holder connection adapted to vary the height of the handle of the dumbbell in relation to the elongated weight bench.

16. The apparatus of claim 10, further comprising:

a second vertically adjustable holder connection adapted to attach the second vertically independent dumbbell holder to the weight bench, the second vertically adjustable holder connection adapted to vary the height of the handle of the dumbbell in relation to the elongated weight bench.

17. The apparatus of claim 10, further comprising:

a first vertically and angularly adjustable holder connection adapted to attach the first vertically independent dumbbell holder to the weight bench, the first vertically and angularly adjustable holder connection adapted to vary the height and angle of the handle of the dumbbell in relation to the elongated weight bench.

18. The apparatus of claim 10, further comprising:

a second vertically and angularly adjustable holder connection adapted to attach the second vertically independent dumbbell holder to the weight bench, the second vertically and angularly adjustable holder connection adapted to vary the height and angle of the handle of the dumbbell in relation to the elongated weight bench.

* * * * *